US008438783B2

(12) United States Patent
Giovannetti

(10) Patent No.: US 8,438,783 B2
(45) Date of Patent: May 14, 2013

(54) OPENING MECHANISM FOR COPLANAR DOORS WITH COMBINED MOVEMENT

(75) Inventor: Antonio Giovannetti, Segrate (IT)

(73) Assignee: Effegi Brevetti S.R.L., Segrate (Milan) (IT)

( * ) Notice: Subject to any disclaimer, the term of this patent is extended or adjusted under 35 U.S.C. 154(b) by 132 days.

(21) Appl. No.: 13/122,009

(22) PCT Filed: Sep. 25, 2009

(86) PCT No.: PCT/IB2009/006961

§ 371 (c)(1),
(2), (4) Date: Mar. 31, 2011

(87) PCT Pub. No.: WO2010/038127

PCT Pub. Date: Apr. 8, 2010

(65) Prior Publication Data

US 2011/0185638 A1 Aug. 4, 2011

(30) Foreign Application Priority Data

Oct. 3, 2008 (IT) ..... MI2008A1766

(51) Int. Cl.
*E05D 13/00* (2006.01)
*E06B 3/46* (2006.01)

(52) U.S. Cl.
USPC ..... 49/130; 49/127; 49/209

(58) Field of Classification Search ..... 49/125–130, 49/209, 216, 221, 223
See application file for complete search history.

(56) References Cited

U.S. PATENT DOCUMENTS

| | | | | | |
|---|---|---|---|---|---|
| 2,144,782 | A | * | 1/1939 | Swanson | 49/130 |
| 2,289,960 | A | * | 7/1942 | Grignet | 49/129 |
| 4,384,429 | A | * | 5/1983 | Rokicki et al. | 49/130 |
| 4,495,729 | A | * | 1/1985 | Britzke et al. | 49/212 |
| 4,574,524 | A | * | 3/1986 | Bonetti et al. | 49/130 |
| 4,644,690 | A | * | 2/1987 | Caimi | 49/130 |

(Continued)

FOREIGN PATENT DOCUMENTS

| | | | |
|---|---|---|---|
| DE | 36 19 775 | A1 | 12/1987 |
| EP | 0 195 880 | A2 | 10/1986 |
| EP | 0 823 527 | A1 | 2/1998 |
| WO | 2007/074397 | A2 | 7/2007 |

OTHER PUBLICATIONS

International Search Report, dated Jun. 8, 2010, from corresponding PCT application.

*Primary Examiner* — Katherine Mitchell
*Assistant Examiner* — Justin Rephann
(74) *Attorney, Agent, or Firm* — Young & Thompson

(57) ABSTRACT

An opening mechanism (1) includes a longitudinal guide (3) fixed to the frame of a furniture unit and, for each door (2), a first slide (4) sliding along the longitudinal guide (3), a second slide (5) which carries the door (2) and which slides transversally on the first slide (4) from a retracted position to an extracted position and vice versa and return elements to bring the second slide (5) back to the retracted position. The second slide (5) is able to rotate with respect to the first slide (4) and presents a curved space (8) in which guide elements (7), integral with the first slide (4). The first slide (4) further includes holding elements (10), controlled by a control surface (51) situated in the longitudinal guide (3), able to lock the second slide (5) in the extracted position when the door (2) is open to prevent the second slide (5) from being brought back to the retracted position by the return elements.

8 Claims, 6 Drawing Sheets

U.S. PATENT DOCUMENTS

| | | | | |
|---|---|---|---|---|
| 4,731,950 | A * | 3/1988 | Ullner | 49/221 |
| 4,949,504 | A * | 8/1990 | Bortoluzzi | 49/130 |
| 5,287,653 | A * | 2/1994 | Young | 49/130 |
| 5,347,757 | A * | 9/1994 | Losito | 49/255 |
| 5,996,282 | A * | 12/1999 | Giovannetti | 49/130 |
| 6,094,866 | A * | 8/2000 | Busnelli | 49/219 |
| 6,336,246 | B1 * | 1/2002 | Giovannetti | 16/87 R |
| 6,497,072 | B2 * | 12/2002 | Fries | 49/209 |
| 6,826,867 | B1 * | 12/2004 | McDonald et al. | 49/213 |
| 6,860,064 | B2 * | 3/2005 | Bakalar | 49/127 |
| 7,752,789 | B2 * | 7/2010 | Sun et al. | 40/491 |
| 8,113,607 | B2 * | 2/2012 | Slager et al. | 312/304 |
| 2003/0070363 | A1 * | 4/2003 | Bakalar | 49/409 |
| 2003/0150165 | A1 * | 8/2003 | Ronay et al. | 49/127 |
| 2003/0204999 | A1 * | 11/2003 | George et al. | 49/216 |
| 2004/0123524 | A1 * | 7/2004 | Batinli et al. | 49/216 |
| 2005/0235564 | A1 * | 10/2005 | Fronz et al. | 49/209 |
| 2006/0032140 | A1 * | 2/2006 | Arimoto et al. | 49/209 |
| 2006/0225357 | A1 | 10/2006 | Bortoluzzi | |
| 2008/0302016 | A1 * | 12/2008 | Halfon et al. | 49/130 |

* cited by examiner

OPENING MECHANISM FOR COPLANAR DOORS WITH COMBINED MOVEMENT

The present invention refers to the field of the furniture so-called having coplanar doors with a combined movement—in which the opening of the doors is carried out by making the doors slide one over the other—and in particular to furniture (more in general, to the spaces or the openings to be closed with doors) in which, for aesthetic reasons, the closed doors are placed close alongside each other so as to present a viewer with the most continuous surface possible.

In order to open one of the doors it is therefore necessary to disengage it from the adjacent door (or from the adjacent doors) causing them to perform a movement substantially perpendicular to its plane before making it slide parallel to itself to place it over the adjacent door (or over one of the adjacent doors).

Opening mechanisms able to cause a door to perform such a double movement are known to the art and widely used: one of such opening mechanisms is disclosed, purely by way of non limiting example, in European Patent No. 823 527.

The opening mechanisms of the prior art essentially comprise a longitudinal guide (normally an extruded section) fixed to the frame of the furniture unit and, for each door, at least one assembly comprising a first slide sliding along the guide, a second slide sliding transversally on the first slide from a resting (retracted) position to a working (extracted) position, deflector means (normally consisting of a guide bent at 90°, fixed to the bottom of longitudinal guide) to bring the second slide from the resting position to the working position (and vice versa) and return means to bring the second slide back to the resting position.

The second slide carries the door, is brought into to the working position by an appendix thereof which engages in the deflector means, is kept in the working position by said appendix which engages in a longitudinal track formed in the guide and, when it is in the extracted position, translates along the longitudinal guide together with the first slide.

In order to apply the deflector means to the longitudinal guide, it is necessary to remove a portion of the above mentioned track by a mechanical process which increases the production times and costs of the opening mechanism.

Furthermore, the opening mechanisms of the prior art have (or can have) the additional drawback that their length must be correlated to that of the door: it is therefore necessary to produce (and to stock) opening mechanisms of different lengths to manage the opening/closing of doors of different lengths, with obvious increases in the costs of production, of stock management, etc.

SUMMARY OF THE INVENTION

Object of the present invention is to produce an opening mechanism for coplanar doors with a combined movement that is free from the limits and the drawbacks presented by the opening mechanisms of the prior art; this object is achieved with an opening mechanism that has the characteristics set out in independent claim 1.

Further advantageous characteristics of the invention form the subject matter of the dependent claims.

An opening mechanism realized according to the invention differs from an opening mechanism of the prior art essentially in that the second slide can rotate with respect to the first slide around a pin integral with the first slide and presents a curved space (henceforth called a "cam"), wherein guide means integral with the first slide is received.

The opening mechanism preferably further comprises holding means, controlled by a control surface situated on the bottom of the guide along which the opening mechanism slides, which lock the second slide in an extracted position, preventing it from being brought back into the retracted position by return means belonging to the opening mechanism.

BRIEF DESCRIPTION OF THE DRAWINGS

The invention will be now described with reference to an exemplifying but non limiting embodiment, described in the appended figures, wherein:

FIGS. 1A to 4A show enlarged views of the second slide of the opening mechanism in each of FIGS. 1 to 4 and the position on the cam of the second slide of the guide means of the first slide;

DETAILED DESCRIPTION OF THE PREFERRED EMBODIMENTS

Figure 1:
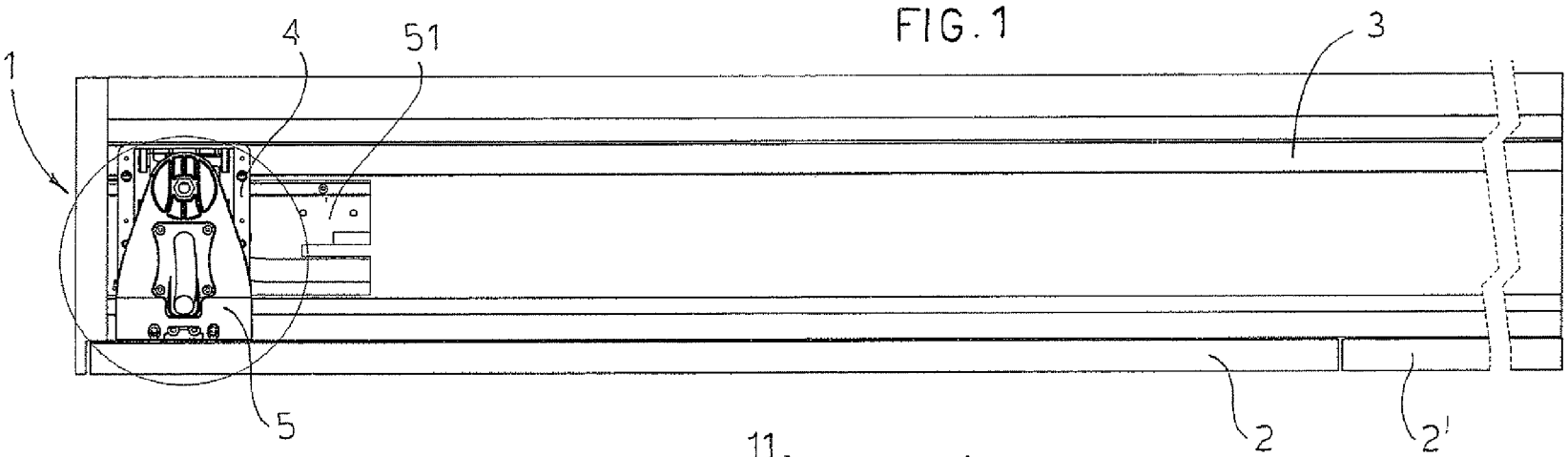
FIGS. 1 to 4 show diagrammatically four top views of an opening mechanism while the door passes from the closed position (FIG. 1) to the open position (FIG. 4)

In the appended figures, corresponding elements will be designated by the same reference numerals.

FIGS. 1 to 4 show diagrammatically four top views of an opening mechanism 1 while the door 2 passes from the closed position (FIG. 1) to the open position (FIG. 4), in which the door 2 is disengaged from the adjacent door and the opening mechanism 1 can translate along the longitudinal guide 3.

FIGS. 1A to 4A show an enlarged view of the second slide 5 of the opening mechanism 1 in each of the FIGS. 1 to 4 and the position in the cam 8 of the second slide 5 of the guide means 7 integral with the first slide 4, not visible because it is covered by the second slide 5.

Figure 1A:
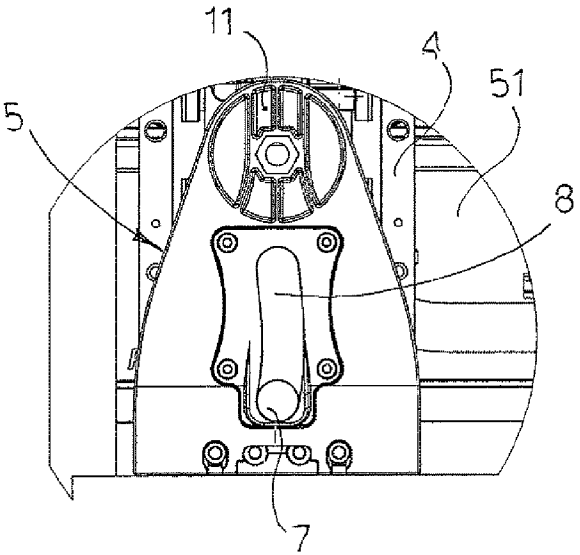

FIG. 1 shows the door 2 in the closed position, that is, aligned with the adjacent door 2': the second slide 5 is positioned over the first slide 4 and, as can be seen better from FIG. 1A, the guide means 7 are at one end of the cam 8 formed in the second slide 5.

Also visible in FIG. 1 is a surface 51, placed on the bottom of the longitudinal guide 3 at the position occupied by the opening mechanism 1 when the door 2 is closed, which controls holding means 10, as will be described with reference to FIGS. 5-7.

As in the opening mechanisms of the prior art, on the bottom of the longitudinal guide 3 there are deflector means 40 (FIGS. 4 and 8) in which an appendix 53 (FIG. 5) of the second slide 5 engages to bring it from the retracted position to the extracted position and vice versa.

Since, as can be seen from FIGS. 1 to 4 and 8, the tracks present in the longitudinal guides of the opening devices of the prior art are not present inside the longitudinal guide 3, it is possible to apply the deflector means 40 (FIGS. 4 and 8) and the controlling surface 51 of the holding means 10 to the bottom of the longitudinal guide 3 without having to carry out mechanical processes.

Figure 2:
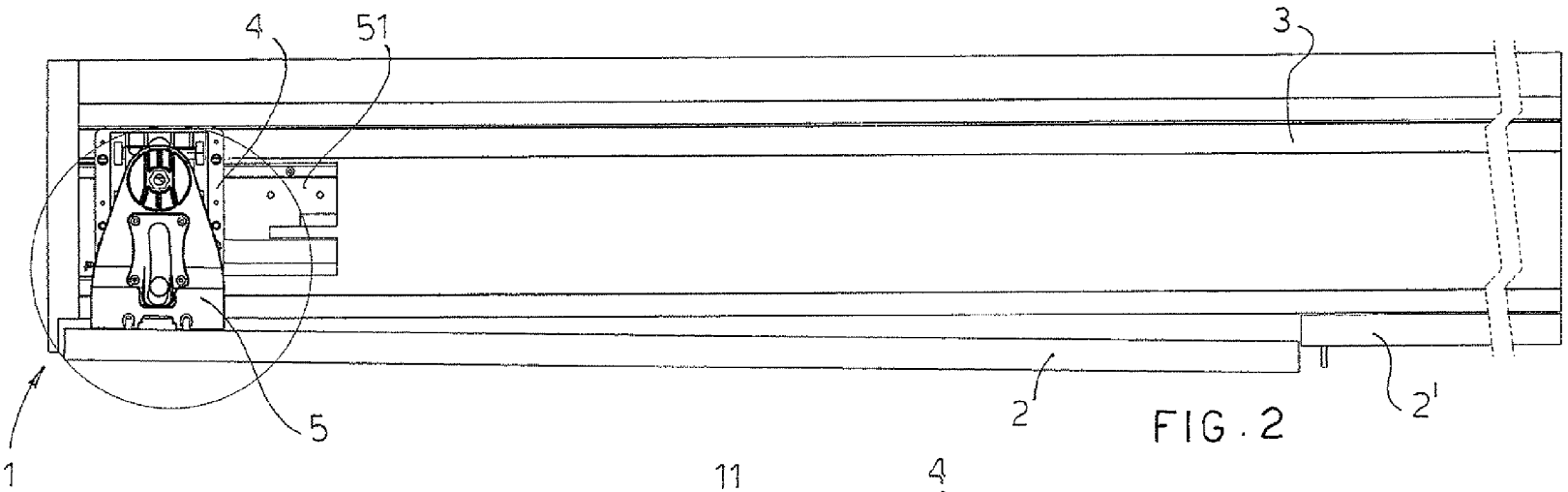
Figure 2A:
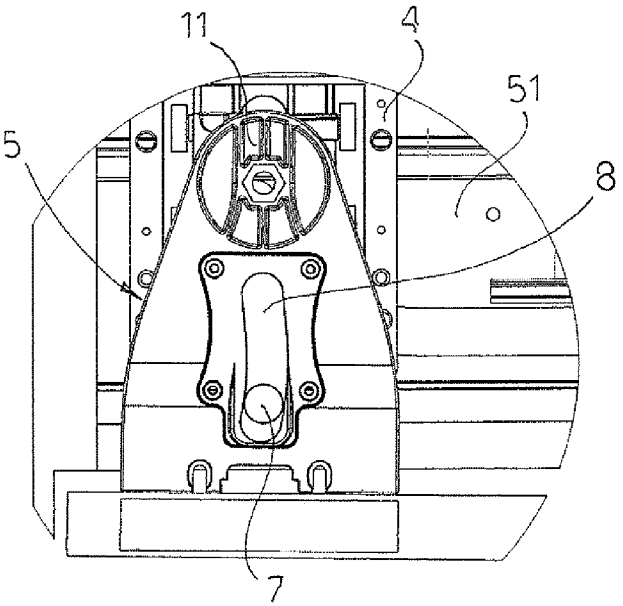

FIG. 2 shows a first step of the opening of the door 2, in which the appendix 53, engaged in the deflector means 40, has caused the second slide 5 to translate with respect to the first slide 4 and, at the same time, to rotate around the pin 11 by the movement in the cam 8 of the guide means 7 which, as can be seen better from FIG. 2A, are no longer situated at one end of said cam.

Figure 3:
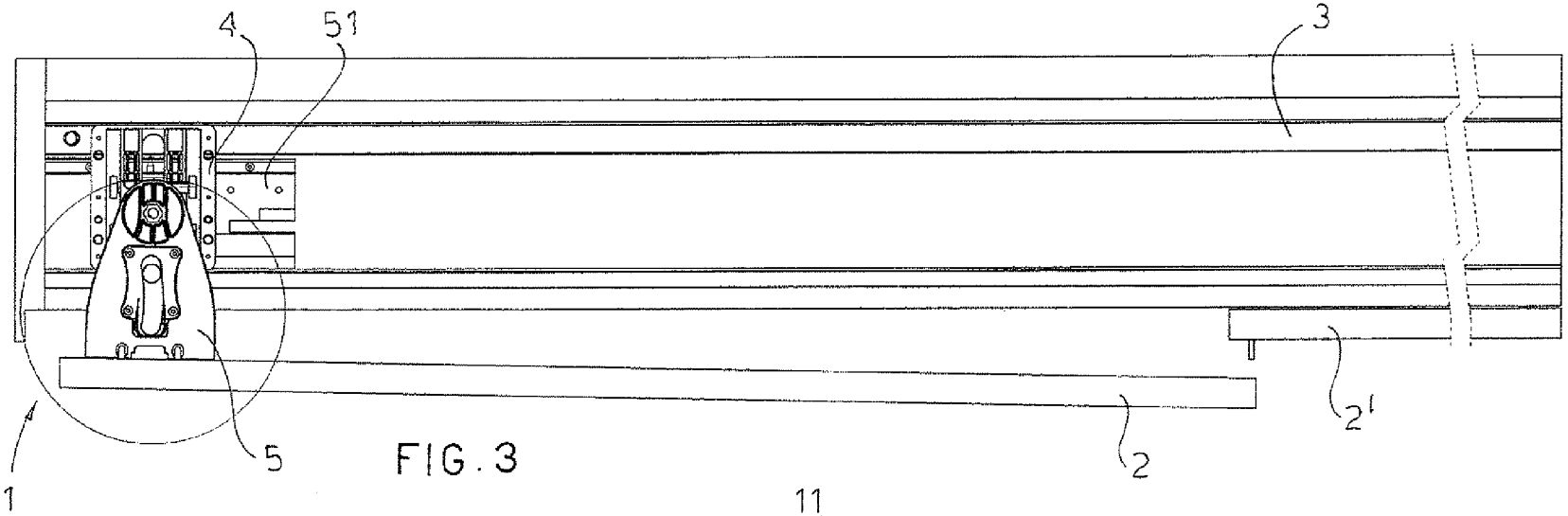
Figure 3A:
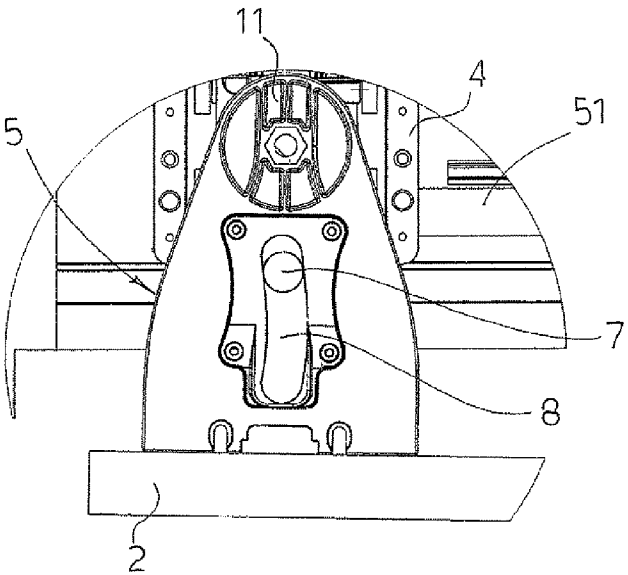

FIG. 3 shows a subsequent step of the opening of the door 2, in which the second slide 5 has been made to translate further with respect to the first slide 4 by the appendix 53 engaged in the deflector means 40 and has been made to rotate around the pin 11 by the further movement of the guide means 7 in the cam 8, disengaging from the adjacent door 2'. In FIG. 3A the new position of the guide means 7 in the cam 8 can be seen better.

The appendix 53 and the deflector means 40 are not visible in FIGS. 2 and 3 because they are covered by the opening mechanism 1.

Figure 4:
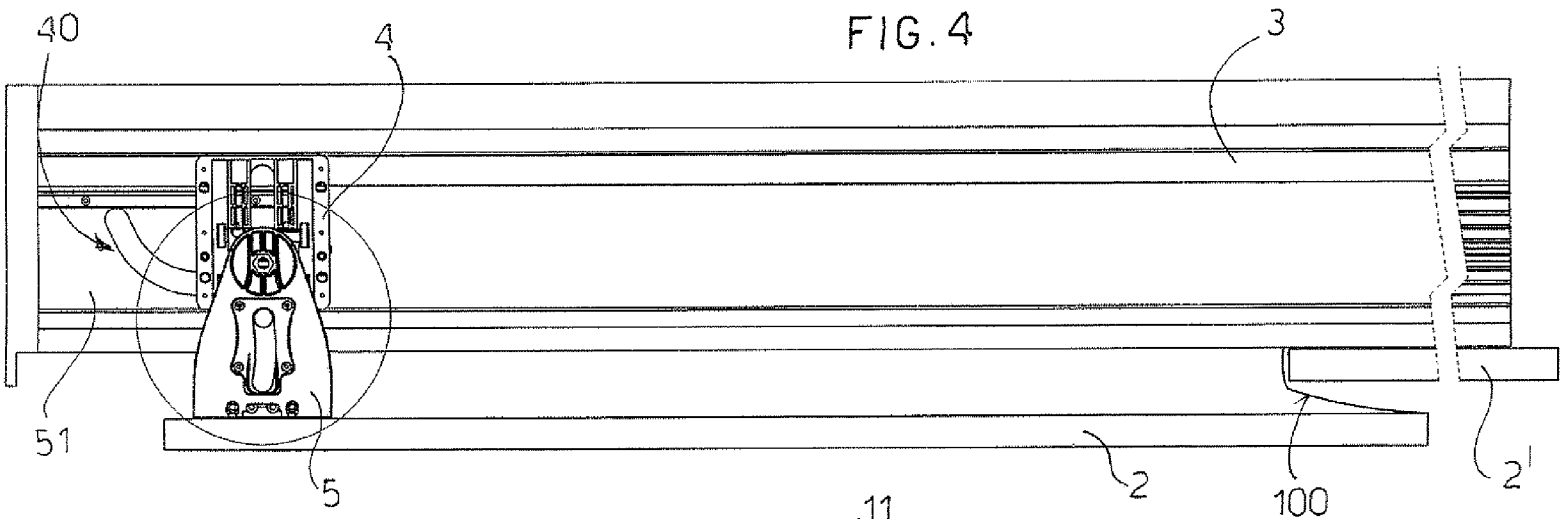

FIG. 4 shows the door 2 in the completely open position, disengaged from the adjacent door 2': when the second slide 5 reaches the extracted position, the door 2 is parallel to the longitudinal guide 3 and to the adjacent door 2' and the opening mechanism 1 can translate along the guide 3.

For greater clarity of the description, in FIG. 4 the numeral 100 indicates the course of the inner edge of the door 2, adjacent the door 2', when the door 2 passes from the closed position to the open position and vice versa.

Figure 4A:
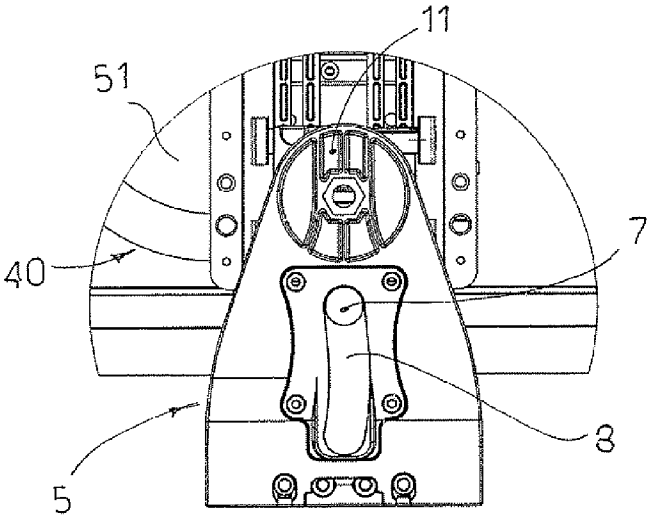

From FIG. 4A it can be seen better that the guide means 7 are situated at the end of the cam 8 opposite to that in which they were situated when the door 2 was in the closed position (FIG. 1).

Furthermore, in the appended figures, the opening mechanism 1 is applied to the door 2 in an off-centre position with respect to the midline of said door, rather than at the centre of the door, as normally occurs in an opening mechanism of the prior art.

This off-centre position of the opening mechanism 1 allows a better "stacking" of the doors one over the other and allows the opening mechanism 1 to act also as a hinge for the door 2 during its opening (or closing) step, when the door 2 disengages from the adjacent door 2' by means of a movement of rotation around the opening mechanism 1, before returning parallel to the longitudinal guide 3 (FIG. 4).

Figure 5:
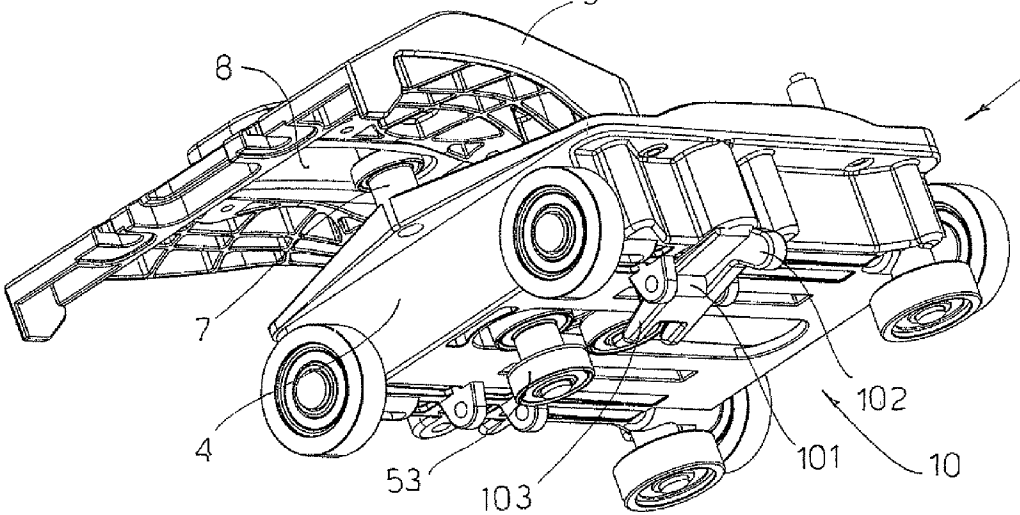
FIG. 5 shows diagrammatically a perspective bottom view of an opening mechanism.

FIG. 5 shows diagrammatically a perspective bottom view of an opening mechanism 1, in which can be seen the guide means 7 integral with the first slide 4, the cam 8 formed in the second slide 5 and the means 10 which, when the door 2 is open, hold the second slide 5 in the extracted position.

Figure 6:
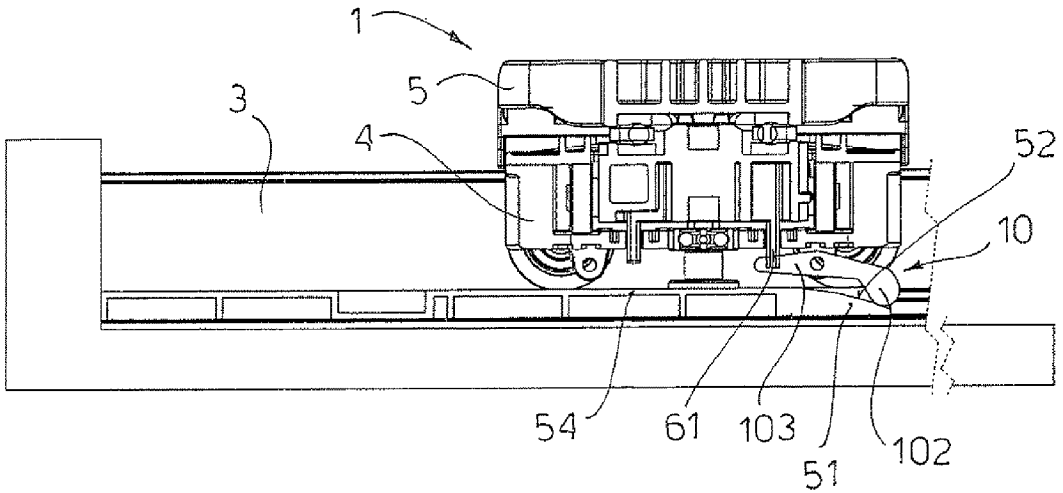
FIG. 6 shows diagrammatically a front view of a mechanism according to the invention, with the second slide engaged by the holding means carried by the first slide.
Figure 7:
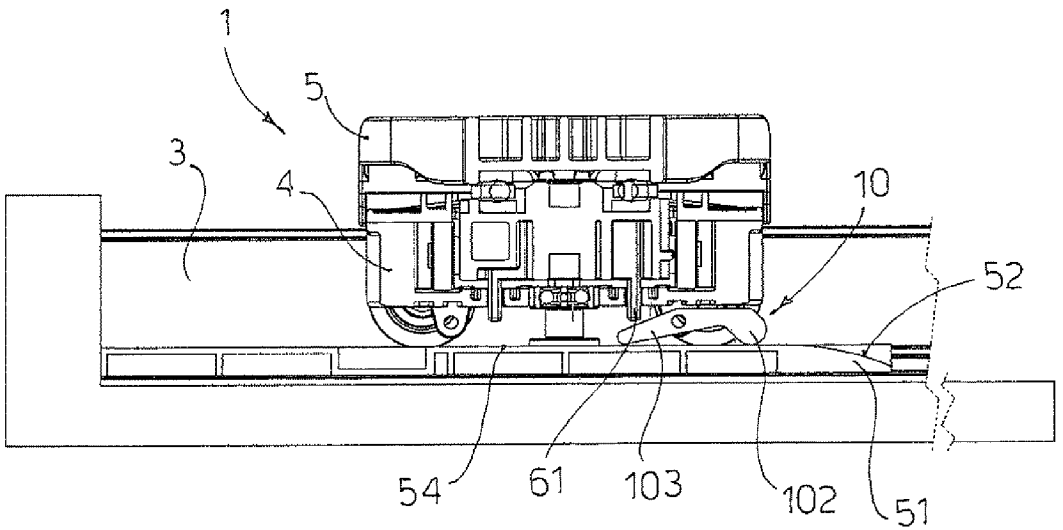
FIG. 7 shows diagrammatically the mechanism of FIG. 6 with the second slide released by the holding means.

These holding means 10, which can be seen better in FIGS. 6 and 7, comprise a lever 101, hinged to the bottom part of the first slide 4 and urged by a spring (omitted in FIGS. 5-7), and stop means 61 integral with the second slide 5: an end 102 of the lever 101 slides on the control surface 51 and on the bottom of the longitudinal guide 3, whereas the other end 103 of the lever 101 can engage with the stop means 61 when the second slide 5 has reached the extracted position (FIG. 6).

The end 103 of the lever 101 keeps the second slide 5 in the extracted position until it is disengaged from the stop means 61 by the action of the controlling surface 51 on the end 102 of the lever 101 (FIG. 7).

FIG. 6 shows diagrammatically a front view of an opening mechanism 1 in which the stop means 61 of the second slide 5 are engaged in the holding means 10 carried by the first slide 4 and controlled by the controlling surface 51, which comprises a flat area 54 raised with respect to the bottom of the guide 3 to which it is joined by an inclined area 52.

FIG. 7 shows diagrammatically the mechanism of FIG. 6 with the second slide 5 released by the holding means 10.

When the door 2 is open, the end 102 of the lever 101 rests on the bottom of the guide 3 and the end 103 of the lever 101, urged by the spring, engages in the stop means 61 (FIG. 6); when the door 2 is closed, the end 102 of the lever 101 rests on the flat, raised area 54 causing the lowering of the end 103 of the lever 101 which disengages from the stop means 61 (FIG. 7).

FIG. 6 shows the mechanism 1 at the end of the opening of the door 2 or at the beginning of the closing thereof, when the end 102 of the lever 101 rests on the inclined area 52 and the end 103 of the lever 101 is engaging/disengaging from the stop means 61.

Without departing from the scope of the invention, it is possible to omit the holding means 10 and the control surface 51, which, however, must be replaced by the track present in the longitudinal guides of the opening devices of the prior art to hold the second slide in the extracted position.

Figure 8:
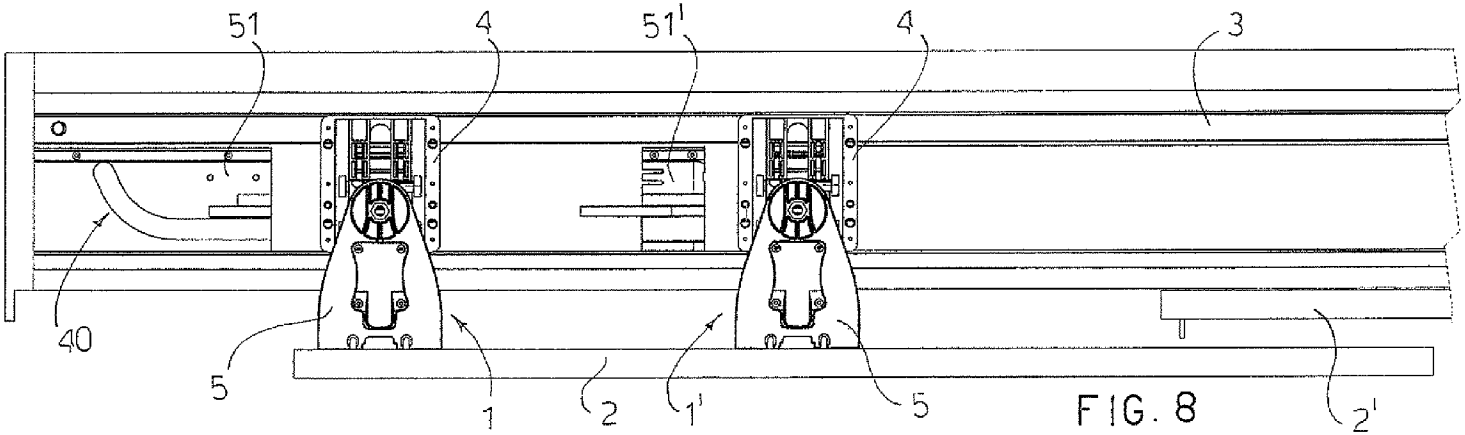
FIG. 8 shows diagrammatically a top view of a door carried by the two opening devices realized according to the invention.

FIG. 8 shows diagrammatically a top view of a door 2 carried by two opening devices (1, 1'); in FIG. 8 two control surfaces (51, 51') are visible, each controlling the holding means of one of the opening devices (1, 1').

The use of a second opening mechanism 1' when the door 2 is too long to be carried by a single device 1 positioned at one end thereof is advantageous because it avoids having to produce and to stock opening mechanisms of different lengths; furthermore it reduces the stresses induced on the opening mechanism 1 by the weight of the door 2 and makes the movement of the door 2 more stable.

Without departing from the scope of the invention, the second opening mechanism 1' comprises the holding means 10, but it does not comprise the cam 8 and the related guide means 7.

The invention claimed is:

1. An opening mechanism (1) for coplanar doors with a combined movement, comprising:

a longitudinal guide (3) fixed to a frame of a furniture unit;

a first slide (4) slidable along the longitudinal guide (3); and a second slide (5) slidable transversally on the first slide (4) from a retracted position to an extracted position and vice versa, the second slide (5) configured to carry a door (2) and, when in the extracted position, to translate along the longitudinal guide (3) together with the first slide (4), wherein the second slide (5) is further configured to rotate with respect to the first slide (4) around a pin (11) integral with the first slide (4), wherein the first slide (4) comprises a guide means (7) integral with the first slide (4), and the second slide (5) presents a curved space (8) in which the guide means (7) is received, and wherein the first slide (4) further comprises holding means (10) controlled by a control surface (51) situated on a bottom of the longitudinal guide (3) at a position occupied by the opening mechanism (1) when the door (2) is closed, the holding means (10) configured to lock the second slide (5) in the extracted position and prevent the second slide (5) from being brought back into the retracted position.

2. The opening mechanism (1) as claimed in claim 1, wherein, when the second slide (5) is in the extracted position, the door (2) is parallel to the longitudinal guide (3) and to an adjacent door (2').

3. The opening mechanism (1) as claimed in claim 1, wherein the holding means (10) comprise a lever (101), hinged to a bottom part of the first slide (4) and urged by a spring, and stop means (61) integral with the second slide (5), an end (102) of the lever (101) sliding on the control surface (51) and on the bottom of the longitudinal guide (3), and an other end (103) of the lever (101) engaging with the stop means (61) when the second slide (5) is in the extracted position.

4. The opening mechanism (1) as claimed in claim 3, wherein the control surface (51) comprises a flat area (54) raised with respect to the bottom of the longitudinal guide (3) to which it is joined by an inclined area (52).

5. The opening mechanism (1) as claimed in claim 4, wherein, when the door (2) is open, the end (102) of the lever (101) rests on the bottom of the longitudinal guide (3) and the other end (103) of the lever (101), urged by the spring, engages in the stop means (61), and wherein, when the door (2) is closed, the end (102) of the lever (101) rests on the raised flat area (54), causing the lowering of the other end (103) of the lever (101), which disengages from the stop means (61).

6. The opening mechanism (1) as claimed in claim 1, wherein the first and second slides are configured to be applied to the door (2) in an off-centre position with respect to a midline of said door (2).

7. The opening mechanism (1) as claimed in claim 6, wherein the first and second slides are configured to function as a hinge for the door (2) during an opening or a closing thereof.

8. The opening mechanism (1) as claimed in claim 1, wherein the control surface (51) comprises a flat area (54) raised with respect to the bottom of the longitudinal guide (3) to which it is joined by an inclined area (52).

* * * * *